United States Patent [19]

Bouchard et al.

[11] Patent Number: 4,904,900

[45] Date of Patent: Feb. 27, 1990

[54] GLOW DISCHARGE LAMP

[75] Inventors: Andre C. Bouchard, Peabody; Paul A. Thibault, Danvers, both of Mass.

[73] Assignee: GTE Products Corporation, Danvers, Mass.

[21] Appl. No.: 377,781

[22] Filed: Jul. 10, 1989

Related U.S. Application Data

[63] Continuation-in-part of Ser. No. 139,398, Dec. 30, 1987, abandoned.

[51] Int. Cl.[4] ..... H01J 61/067; H01J 61/64; H01J 61/42

[52] U.S. Cl. ..... 313/491; 313/619; 313/622; 313/623

[58] Field of Search ..... 313/619, 622, 285, 623, 313/491

[56] References Cited

U.S. PATENT DOCUMENTS

| | | | |
|---|---|---|---|
| 1,990,171 | 2/1935 | Ewest et al. | 313/619 |
| 2,121,641 | 6/1938 | Mickley | 313/285 X |
| 2,315,504 | 4/1943 | Curtis | 313/285 X |
| 2,341,990 | 2/1944 | Inman et al. | 315/107 X |
| 2,403,184 | 7/1946 | Lemmers | 313/622 X |
| 2,453,978 | 11/1948 | Elmendorf | 313/623 |
| 2,804,565 | 8/1957 | Townsend | 313/619 X |
| 2,917,651 | 12/1959 | Schagen | 313/619 X |
| 3,819,970 | 6/1974 | Roche | 313/623 X |
| 4,408,141 | 10/1983 | Byszewski et al. | 315/56 |
| 4,413,204 | 11/1983 | Byszewski et al. | 313/491 |
| 4,441,051 | 4/1984 | Thomas | 313/579 X |
| 4,450,380 | 5/1984 | Proud et al. | 313/485 |
| 4,494,046 | 1/1985 | Budinger et al. | 315/260 |
| 4,516,057 | 5/1985 | Proud et al. | 315/260 |
| 4,518,897 | 5/1985 | Proud et al. | 315/260 |
| 4,521,718 | 6/1985 | Byszewski et al. | 315/99 |
| 4,727,286 | 2/1988 | Keenan et al. | 313/579 X |

*Primary Examiner*—Palmer C. DeMeo
*Attorney, Agent, or Firm*—Carlo S. Bessone

[57] ABSTRACT

A glow discharge lamp that includes a light transmitting envelope containing a noble gas fill material and a pair of electrodes disposed in the envelope. Lead-in wires couple to the electrodes and extend to and are hermetically sealed in the envelope. The anode electrodes is comprised of a refractory metal piece, preferably a molybdenum foil strip, supported from an end of a single lead-in wire that is preferably swagged to the metal strip.

19 Claims, 1 Drawing Sheet

GLOW DISCHARGE LAMP

This application is a continuation-in-part of application Ser. No. 139,398, filed Dec. 30, 1987, and now abandoned.

TECHNICAL FIELD

The present invention relates in general to a compact fluorescent lamp and pertains, more particularly, to a negative glow discharge lamp.

BACKGROUND

A glow lamp typically is comprised of a light transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. Examples of typical glow discharge lamps are found in U.S. Pat. Nos. 2,067,129 to Marden; 3,814,971 to Bhattacharya; and 4,408,141 to Byszewski, et al.

Reference is also now made herein to a co-pending application Ser. No. 139,397 filed concurrently herewith on a DC operated negative glow discharge lamp employing a cathode coated with an emissive material and a bare anode. FIG. 1 herein illustrates a glow discharge lamp of this type including an envelope 10 that is provided with a phosphor coating as illustrated at 12. There may be one or more electron emitting electrodes (cathodes) and one or more electron collecting electrodes (anodes). FIG. 1 in particular illustrates a cathode electrode 14 and an anode electrode 16. These electrodes are supported by respective lead-in wires 15 and 17.

In FIG. 1 the envelope 10 is generally of spherical shape having a generally maximum cross-section bulbous region 18 and also including a neck region 20. The lead-in wires 15 and 17 are typically hermetically sealed at the neck region 20 with a wafer stem assembly. In FIG. 1 the electrodes 14 and 16 are supported primarily in a side-by-side relationship and are approximately at the maximum cross-section bulbous region 18.

In operation, the cathode emits electrons that are accelerated so that mercury vapor is excited in the extended region of the low pressure gas. In this connection the envelope may be filled with a conventional fill material including mercury and a noble gas or mixtures of noble gases. A suitable noble gas is neon. Furthermore, the lamp can be operated from either an AC or DC power source.

In the glow discharge lamp described in co-pending Application Ser. No. 139,397 filed concurrently herewith, the cathode electrode is coated with an emissive material while the anode electrode is uncoated. The anode electrode is typically a bare tungsten coil electrode. The lamp is operated in a DC mode of operation rather than an AC mode of operation. This lamp construction provides improved lumen maintenance and longer life span, particularly in comparison to prior art glow lamp constructions. However, a tungsten electrode, devoid of an emissive coating while serving as an anode, in a DC operated lamp, can have certain drawbacks associated therewith. Generally, two lead-in wires are required to support the tungsten electrode. Furthermore, the tungsten electrode is costly, particularly in comparison to the cost of the lead-in wires. Moreover, the tungsten electrode can cause a power loss in the lamp circuit due to IR heating of the electrode during lamp operation.

DISCLOSURE OF THE INVENTION

One object of the present invention is to provide an improved glow discharge lamp construction having, in particular, an improved anode construction.

Another object of the present invention is to provide an improved negative glow discharge lamp having an improved anode construction requiring only single lead-in wire support.

A further object of the present invention is to provide an improved negative glow discharge lamp that is adapted for DC power operation.

Still another object of the present invention is to provide an improved negative glow discharge lamp having an anode that is of relatively inexpensive construction, that is of simplified construction, and that is characterized by improved overall luminance output and operating life span.

To accomplish the foregoing and other objects, features and advantages of the invention there is provided a glow discharge lamp that is comprised of a light transmitting envelope containing a noble gas fill material. A pair of electrodes are disposed in the envelope and lead-in wires are associated with the electrodes for support thereof. These lead-in wires extend through and are hermetically sealed in the envelope. One of the pair of electrodes comprises a refractory metal piece supported from an end of one of the lead-in wires. A power supply means is provided coupled to the electrodes via the lead-in wires and for operating the electrodes in a DC mode of lamp operation. The electrode that comprises a refractory metal piece is an anode electrode and the other electrode of the pair of electrodes is a cathode electrode. The refractory metal piece may comprise a refractory metal strip having a thickness substantially less than the strip cross-sectional area. The refractory metal strip may be a molybdenum foil strip. In the embodiment disclosed herein the molybdenum foil strip mentioned has dimensions on the order of 4.5 mm wide, 16.5 mm long and 0.01 mm thick. The spacing between cathode and anode electrodes may be on the order of 1.5 cm. The refractory metal strip is supported by only a single lead-in wire that is preferably constructed of a refractory metal such as molybdenum. The single lead-in wire extends longitudinally across the refractory metal strip and has a swagged end securing the refractory metal strip therebetween. For this purpose the lead-in wire has a reverse curve at this swagged end. The swagged end of the lead-in wire may be spread to approximate the width of the refractory metal strip.

In accordance with further aspects of the present invention, the envelope contains mercury and emits ultraviolet radiation upon excitation. A phosphor coating is provided on an inner surface of the envelope and this emits visible light upon absorption of ultraviolet radiation. The noble gas fill material may comprise a mixture of neon and argon. A wafer stem assembly may be employed for hermetically sealing the lead-in wires in the envelope. The lamp envelope is generally of spherical construction having a maximum cross-section bulbous region with the pair of electrodes being disposed at the envelope cross-section bulbous region. The pair of electrodes are disposed in a side-by-side relationship. The cathode electrode is coated with an emissive material. The cathode electrode is typically a coil and the coil is aligned with the center of the anode electrode strip.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
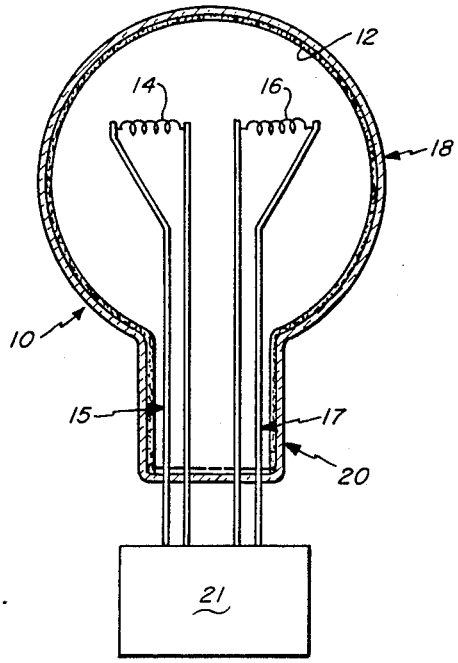
FIG. 1 is an elevation cross-sectional view of a glow discharge lamp employing a cathode with an emissive coating and a bare anode operated from a DC source.

Reference has been made in the background discussion herein to the standard glow discharge lamp of FIG. 1. The electrodes 14 and 16 described therein are disposed in side-by-side position. The electrodes are located in the most bulbous region 18 of the envelope and are typically spaced approximately 1–3 centimeters apart. The electrodes 14 and 16 are both coated with an emissive coating such as one of barium, strontium and calcium carbonates that are converted to oxides during lamp processing. As indicated previously, these electrodes (filaments) are both coated because the lamp is normally driven by an alternating power source, such as the alternating power source 21, depicted if FIG. 1, so that each electrode has to function alternately, in time, as a cathode and anode, respectively. As also indicated previously glow lamps of this type when operated from an AC source have a short lifetime and poor lumen maintenance due to the evaporation of emissive material onto the lamp walls surrounding the electrodes.

Now, in accordance with the present invention, there is now described in FIG. 2–5 an improved glow discharge lamp construction wherein, in particular, the anode electrode is of improved construction. The anode electrode is constructed more simply and more inexpensively than with prior constructions. Furthermore, the anode electrode requires only a single lead-in wire support. More particularly, in accordance with a preferred anode construction described herein, the anode is made of an inexpensive strip of molybdenum foil clamped to the end of a single lead-in wire that is also preferably a molybdenum lead-in wire.

Figure 2:
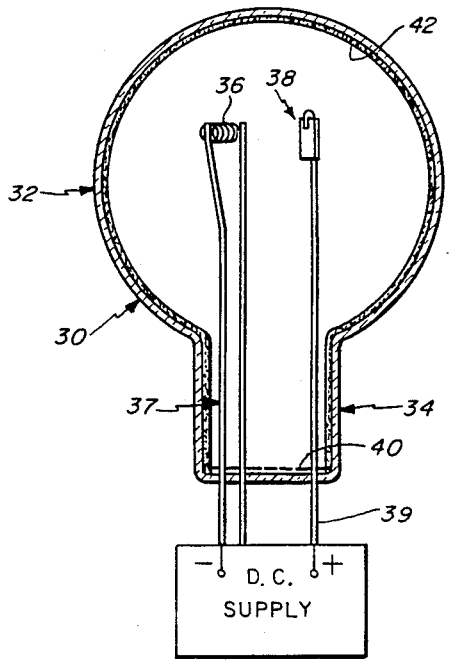
FIG. 2 is a front elevation cross-sectional view of a preferred embodiment of a glow discharge lamp constructed in accordance with the principles of the present invention and employing a single lead-in wire for anode electrode support.

Now, reference is made in particular to FIG. 2 for the improved lamp construction of the present invention. In FIG. 2 there is illustrated the lamp envelope 30 that has a bulbous region 32 and a neck region 34. Within the envelope 30 there is disposed a cathode electrode 36 and an anode electrode 38. The cathode electrode 36 may be a standard No. 41 tungsten exciter coil. Lead-in wires 37 support the cathode electrode 36 and, as noted in FIG. 2, a single lead-in wire 39 supports the anode electrode 38. The lead-in wires may be rod-like of say 20–30 mil diameter. Both the lead-in wires 37 and a single lead-in wire 39 are hermetically sealed such as by means of a wafer stem assembly 40 that closes the bottom neck region 34 of the lamp envelope as illustrated in FIG. 2. The lead-in wires 37 are preferably also constructed of molybdenum to provide proper lamp construction and operation.

It was discovered that during operation of the glow discharge lamp, the discharge is attracted to the interface between the metal strip and the lead-in wire. The temperature at the interface, which is in the order of from 1000 to 1300 degrees Celsius, causes nickel from the commonly used nickel lead-in wires to evaporate. This evaporation of nickel discolors the phosphor coating and adversely affects lamp life.

In the embodiment of FIG. 2 the envelope contains a fill material that emits ultraviolet radiation upon excitation. This fill material may contain mercury and a noble gas or mixture of noble gases. In one embodiment the lamp may be filled with a noble gas mixture at 3 torr. This mixture may be 99.5% neon and 0.5% argon with approximately 30 mg in weight of mercury.

Since lamp efficiency is dependent upon the work function of the electrodes, it is desirable to form the anode with a work function as low as possible. The work function of molybdenum, for example, is 4.5. During lamp operation, barium from the emissive material on the cathode vaporizes and is deposited on the anode electrode. The deposited barium further lowers the work function provided the reaction at the interface is at a proper elevated temperature. The relatively thin foil used in the present invention causes the anode to operate hotter than, for example, a plate-type anode and thereby is substantially more likely to reduce the work function of the anode. In addition to reducing the work function, the foil of the present invention can be outgassed more easily than a plate-type anode and can be secured more easily to the lead-in wire.

Figures 3A, 3B:
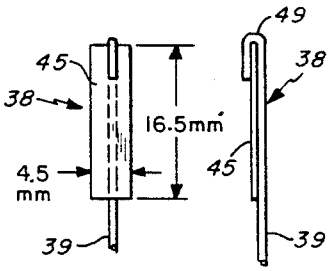
FIGS. 3A and 3B are respective front and side elevation views of the improved anode construction in accordance with the present invention.
Figure 4:
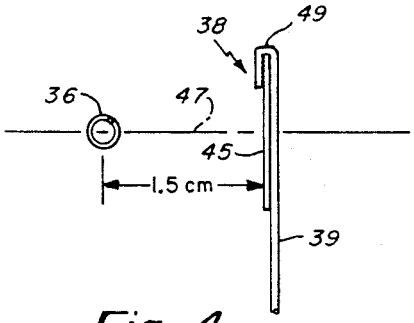
FIG. 4 is an enlarged detailed diagram illustrating the anode and cathode constructions and the relative positioning therebetween.

As indicated previously, the anode electrode 38 is constructed of an inexpensive strip of molybdenum foil 45 as illustrated in, for example, FIGS. 3 and 4. In one embodiment of the invention the molybdenum foil is 4.5 mm wide, 16.5 mm long (refer to FIG. 3A) and 0.01 mm thick (refer to FIG. 3B). In accordance with the teachings of the present invention, the thickness of the foil should be less than about 0.025 millimeter. A preferred spacing between the cathode electrode and anode electrode is approximately 1.5 cm as illustrated in FIG. 4. The cathode and anode electrodes are preferably approximately centered relative to each other as also illustrated in FIG. 4. Note in FIG. 4 the representative center line 47. In addition to using a molybdenum foil strip one may also use a strip of tungsten or tantalum.

Figures 5A, 5B:
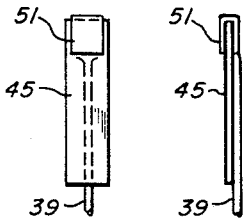
FIGS. 5A and 5B show an alternate anode construction.

Since refractory metals are by their very nature nonductile, they do not lend themselves very well to mechanical attachment involving bending. One would expect a mechanical connection (without a weld) formed between refractory metals to have a relatively high resistance which would cause a undesirable voltage drop at the connection. Consequently, molybdenum ribbon used in the press seal of fused quartz tubing is secured to a molybdenum wire by means of welding. The welding procedure is complicated by the fact that it requires the use of a flux metal (i.e., platinum) placed between the foil-wire junction prior to welding. It was discovered that the thin molybdenum foil of the present invention can be used effectively as an anode and secured more easily to the molybdenum lead-in wire by merely swagging one end of the lead-in wire over one end of the foil. Preferably, the entire length of at least one of the longitudinal surfaces of the foil is in a contiguous relationship with a portion of the lead-in wire supporting the foil as illustrated in FIGS. 3B, 4 and 5B. The contact resistance was found to be less than 0.2 ohm.

The molybdenum foil strip 45 may be secured to the lead-in wire 39 by providing a turned end 49 on the very end of the lead-in wire 39. This permits the end 49 to be swagged securing the molybdenum foil strip at its very top end therebetween. In addition, one may provide a solder, adhesive or weld seal between the lead-in wire 39 and foil strip 45.

Reference is also now made to a further alternate construction illustrated in FIGS. 5A and 5B in which the molybdenum foil strip is secured to the lead-in wire by swagging the lead-in wire. This flattens the lead-in wire, as indicated at 51 in FIGS. 5A and 5B, so as to increase the surface of the lead-in wire end. The lead-in wire may be selected to be of a diameter so that when it is swagged it spreads so that the surface of the end of the wire approximates that of the width of the molybdenum foil strip as shown in FIG. 5. This provides a quite simplified anode construction.

While there have been shown and described what are at present considered the preferred embodiments of the invention, it will be obvious to those skilled in the art that various changes and modifications may be made therein without departing from the scope of the invention as defined by the appended claims.

What is claimed is:

1. A glow discharge lamp comprising;

a light transmitting envelope containing a noble gas fill material;

a pair of electrodes disposed in said envelope;

lead-in wires coupled to the electrodes and extending through and hermetically sealed in said envelope, one of said electrodes comprising a refractory metal piece having a thickness less than about 0.025 millimeter and supported from an end of one of said lead-in wires, said one of said lead-in wires being of a refractory material.

2. A glow discharge lamp as set forth in claim 1 wherein the envelope also contains mercury and emits ultraviolet radiation upon excitation.

3. A glow discharge lamp as set forth in claim 2 including a phosphor coating on an inner surface of said envelope and which emits visible light upon absorption of ultraviolet radiation.

4. A glow discharge lamp as set forth in claim 3 wherein said noble gas fill material comprises a mixture of neon and argon.

5. A glow discharge lamp as set forth in claim 1 including a wafer stem assembly for hermetically sealing the lead-in wires in the envelope.

6. A glow discharge lamp as set forth in claim 1 wherein the lamp envelope has a maximum cross-section bulbous region with the pair of electrodes being disposed at said envelope maximum cross-section bulbous region.

7. A glow discharge lamp as set forth in claim 6 wherein said pair of electrodes are disposed in a side-by-side relationship.

8. A glow discharge lamp as set forth in claim 1 including power supply means coupled to said electrodes via said lead-in wires for operating said pair of electrodes in a DC mode of lamp operation.

9. A glow discharge lamp as set forth in claim 1 wherein said one electrode is an anode electrode and the other electrode of the pair of electrodes is a cathode electrode.

10. A glow discharge lamp as set forth in claim 9 wherein said refractory metal piece comprises a molybdenum foil strip.

11. A glow discharge lamp as set forth in claim 10 wherein said molybdenum foil strip is dimensioned on the order of 4.5 mm wide, 16.5 mm long and 0.01 mm thick.

12. A glow discharge lamp as set forth in claim 11 wherein the spacing between cathode and anode electrodes is on the order of 1.5 cm.

13. A glow discharge lamp as set forth in claim 12 wherein the cathode electrode is coated with an emissive material, the cathode electrode is a coil and the coil is aligned with the center of the anode electrode strip.

14. A glow discharge lamp as set forth in claim 10 wherein the refractory metal strip is supported by only a single lead-in wire.

15. A glow discharge lamp as set forth in claim 14 wherein a portion of the single lead-in wire extends longitudinally of the refractory metal strip in a contiguous relationship with the entire length of at least one of the longitudinal surfaces of said metal strip, said single lead-in wire having a swagged end securing the refractory metal strip therebetween.

16. A glow discharge lamp as set forth in claim 15 wherein the single lead-in wire has a reverse curve at the swagged end.

17. A glow discharge lamp as set forth in claim 16 wherein the swagged end of the lead-in wire is spread to approximate the width of the refractory metal strip.

18. A glow discharge lamp as set forth in claim 10 wherein said refractory metal strip is selected from a group comprising molybdenum, tungsten and tantalum.

19. A glow discharge lamp as set forth in claim 9 wherein said cathode lead-in wires comprise molybdenum wires.

* * * * *